US012137831B2

(12) United States Patent
Berman et al.

(10) Patent No.: US 12,137,831 B2
(45) Date of Patent: Nov. 12, 2024

(54) BRACKET FOR SURFACE MOUNTING

(71) Applicant: House of Atlas, LLC, Evanston, IL (US)

(72) Inventors: Matthew Berman, Chicago, IL (US); Jason Moss, Libertyville, IL (US); Alan Arthur Ford, Sturgis, MI (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 18/376,387

(22) Filed: Oct. 3, 2023

(65) Prior Publication Data

US 2024/0032717 A1 Feb. 1, 2024

Related U.S. Application Data

(63) Continuation of application No. 17/879,640, filed on Aug. 2, 2022, now Pat. No. 11,805,931, which is a continuation of application No. 16/800,594, filed on Feb. 25, 2020, now Pat. No. 11,452,398, which is a continuation-in-part of application No. 16/749,770, filed on Jan. 22, 2020, now abandoned.

(51) Int. Cl.
*A47H 1/142* (2006.01)
*A47H 1/122* (2006.01)

(52) U.S. Cl.
CPC ..... *A47H 1/142* (2013.01); *A47H 1/122* (2013.01)

(58) Field of Classification Search
CPC ..... A47H 1/142; A47H 1/122
USPC ..... 248/261, 262, 263
See application file for complete search history.

(56) References Cited

U.S. PATENT DOCUMENTS

| | | | | |
|---|---|---|---|---|
| 241,991 | A | 5/1881 | Jones | |
| 331,850 | A | 12/1885 | Umstadter | |
| 446,675 | A | 2/1891 | Glidden | |
| 568,628 | A * | 9/1896 | Ruebel | A47H 1/122 248/265 |
| 726,950 | A | 5/1903 | Larson | |
| 732,821 | A | 7/1903 | Bitner | |
| 762,594 | A | 6/1904 | Christopher | |

(Continued)

FOREIGN PATENT DOCUMENTS

FR 2898795 9/2007

OTHER PUBLICATIONS

Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.

(Continued)

*Primary Examiner* — Muhammad Ijaz
(74) *Attorney, Agent, or Firm* — Fitch, Even, Tabin & Flannery LLP

(57) ABSTRACT

A bracket for mounting objects to a wall includes a base defining mounting holes for fasteners. An arm extends from the base and has a top, a bottom and a maximum width at the interconnection with the base. The mounting holes includes at least two that are spaced from another by a distance greater than a maximum width of the arm so that one of the mounting holes is outside the arm on one side of the arm and another of the mounting holes is outside the arm on the other side of the arm. At least a portion of the mounting holes is located above the top of the arm.

19 Claims, 18 Drawing Sheets

(56) References Cited

U.S. PATENT DOCUMENTS 828,503 A 8/1906 Powell
940,711 A 11/1909 Eells
969,051 A 8/1910 Garraway
999,675 A 8/1911 Schmitz
1,004,471 A 9/1911 Rose
1,024,349 A 4/1912 Mattern
1,033,440 A 7/1912 Moffat
1,052,447 A 2/1913 Armstrong
1,104,545 A 7/1914 Reitz
1,115,997 A 11/1914 Withrow
1,120,935 A 12/1914 Hammers
D47,004 S 2/1915 Martin
1,187,366 A 6/1916 Sylvester
1,333,163 A 3/1920 Eddy
D55,157 S 5/1920 Dubish
1,341,535 A 5/1920 Becker
1,384,246 A 7/1921 Durnell
1,445,372 A 2/1923 Jene
1,451,764 A 4/1923 Dick
1,461,855 A 7/1923 Kroesser
1,492,210 A 4/1924 Kelly
1,498,849 A 6/1924 London
1,525,895 A 2/1925 Walter, V
1,530,167 A 3/1925 Friend
1,593,114 A 7/1926 Wyatt
1,596,506 A 8/1926 Morgan
1,658,815 A 2/1928 Oskamp
D76,109 S 8/1928 Vermillion
1,805,784 A 5/1931 Peterson
1,809,216 A 6/1931 Quandt
D101,104 S 7/1936 Bushey
2,135,159 A 11/1938 Zbock
2,151,223 A 3/1939 Nayman, Sr.
2,234,099 A 3/1941 Westfall
2,240,225 A 4/1941 Place
2,288,303 A 6/1942 Ryan
2,293,168 A 8/1942 Pirone
2,374,787 A 5/1945 Spiegel
2,386,854 A 10/1945 Hilton
2,474,434 A 6/1949 Mentz
2,484,855 A 10/1949 Press
2,644,191 A 7/1953 Meyer
2,720,373 A 10/1955 Bell
2,725,989 A 12/1955 Burkey
2,783,014 A 2/1957 Kenney
2,789,783 A 4/1957 Jones
2,848,184 A 8/1958 Kennedy
2,859,879 A 11/1958 Rogers
2,964,280 A * 12/1960 Rinaldi ..... A47H 1/122
248/265
3,049,327 A 8/1962 Caudell
3,104,086 A 9/1963 Salzmann
3,199,823 A * 8/1965 Stall ..... A47H 1/122
248/265
3,219,302 A 11/1965 Smith
3,289,992 A 12/1966 Brooks
3,312,442 A 4/1967 Moeller
3,430,908 A 3/1969 Kowalczyk
3,704,851 A 12/1972 Cormier
3,724,085 A 4/1973 Wentworth
3,778,955 A 12/1973 Close
3,857,538 A 12/1974 Williamson
3,912,211 A 10/1975 Topf
D242,986 S 1/1977 Inglis
4,039,136 A 8/1977 Dehart
4,060,905 A 12/1977 Light
D251,180 S 2/1979 Mader
4,140,294 A 2/1979 Zwarts
D253,162 S 10/1979 Sheehan
4,226,395 A 10/1980 Bellinger
4,291,996 A 9/1981 Gilb
4,316,546 A 2/1982 Varon
4,322,050 A * 3/1982 Roach ..... A47H 1/122
248/265
4,455,007 A 6/1984 Varon
4,473,957 A 10/1984 Faulkner
4,509,713 A 4/1985 Hogg
D290,931 S 7/1987 Powell
4,684,095 A 8/1987 Athey
4,708,311 A 11/1987 Clausen
4,878,528 A 11/1989 Kobayashi
5,028,030 A 7/1991 Lewis
5,054,728 A 10/1991 Nigro, Jr.
5,103,574 A 4/1992 Levy
5,193,775 A 3/1993 Wagnon
5,195,570 A 3/1993 Marocco
5,398,900 A 3/1995 Schober
5,577,700 A 11/1996 Williams
D376,755 S 12/1996 Cox
5,678,703 A 10/1997 Sawyer
D389,035 S 1/1998 Smiley
5,802,729 A 9/1998 O'Brien
5,803,425 A 9/1998 McCoy, II
D408,722 S 4/1999 Sartini
D411,951 S 7/1999 Baranski
5,927,675 A 7/1999 Kratish
5,979,848 A 11/1999 Kuthy
5,996,791 A 12/1999 Bibby
D420,567 S 2/2000 Laga
6,233,877 B1 5/2001 Monroe
6,325,349 B1 12/2001 Breaux
6,357,716 B1 3/2002 Kratish
D455,334 S 4/2002 Ivankovic
6,367,755 B1 4/2002 Arena
6,371,423 B1 4/2002 Miller
6,371,427 B1 4/2002 Johnson
6,409,140 B1 6/2002 Kratish
6,450,233 B1 9/2002 Becker
D464,013 S 10/2002 Adams
6,471,175 B1 10/2002 Kratish
6,481,584 B1 11/2002 Cantley
6,554,237 B1 4/2003 Weber
D478,804 S 8/2003 Titus
6,640,512 B1 11/2003 Kinnaman
6,695,276 B2 2/2004 Skorka
6,739,065 B2 5/2004 Hofmeister
7,128,124 B2 10/2006 Bibby
D542,897 S 5/2007 Harwanko
7,210,243 B2 5/2007 Schmidt
7,322,552 B1 * 1/2008 Lin ..... A47H 1/13
248/254
7,448,507 B1 11/2008 Abernathy, Jr.
D586,647 S 2/2009 Didehvar
7,509,752 B2 3/2009 Schmidt
D602,344 S 10/2009 Olien
D611,328 S 3/2010 Hanley
7,798,463 B2 9/2010 Morgenroth
7,802,769 B1 9/2010 Lindsey
7,861,989 B2 1/2011 Cross
D638,282 S 5/2011 Robinson
8,011,635 B2 9/2011 Aleo
D646,957 S 10/2011 Syed
8,056,873 B1 11/2011 Hanely
8,069,507 B2 12/2011 Didehvar
D658,043 S 4/2012 Burr
8,185,981 B2 5/2012 Didehvar
8,214,938 B2 7/2012 Hanley
8,231,093 B2 7/2012 Tran
D667,295 S 9/2012 Harwanko
8,297,576 B2 10/2012 Mcleod
D670,522 S 11/2012 Cittadino
D670,944 S 11/2012 Cittadino
D672,178 S 12/2012 Walker
D672,990 S 12/2012 Lindo
D672,991 S 12/2012 Cittadino
8,341,775 B2 1/2013 Didehvar
8,356,782 B2 1/2013 Robichaud
D678,754 S 3/2013 Burr
8,418,975 B1 4/2013 Burr
D681,422 S 5/2013 Lindo
D681,423 S 5/2013 Walker
D684,037 S 6/2013 Harwanko
D691,029 S 10/2013 Didehvar
D691,030 S 10/2013 Lindo

(56) References Cited

U.S. PATENT DOCUMENTS

| | | | | |
|---|---|---|---|---|
| D691,031 | S | 10/2013 | Harwanko | |
| D693,209 | S | 11/2013 | Walker | |
| D696,573 | S | 12/2013 | Didehvar | |
| 8,640,890 | B2 * | 2/2014 | Schiller | F16B 47/00 211/85.15 |
| D707,535 | S | 6/2014 | Burr | |
| 8,814,114 | B2 | 8/2014 | Baines | |
| 8,844,886 | B2 | 9/2014 | Mejia | |
| 8,851,435 | B1 | 10/2014 | Bastien | |
| 8,869,999 | B2 | 10/2014 | Lindo | |
| 8,978,228 | B2 | 3/2015 | Didehvar | |
| 8,979,911 | B2 | 3/2015 | Martineau | |
| 9,009,878 | B2 | 4/2015 | Baines | |
| 9,021,627 | B2 | 5/2015 | Parker | |
| 9,107,529 | B2 | 8/2015 | Didehvar | |
| 9,131,795 | B2 | 9/2015 | Didehvar | |
| 9,216,045 | B2 | 12/2015 | Martineau | |
| D746,667 | S | 1/2016 | Vaccaro | |
| 9,271,592 | B2 | 3/2016 | Didehvar | |
| 9,474,421 | B2 | 10/2016 | Baines | |
| 9,486,913 | B2 | 11/2016 | Thieman | |
| 9,532,663 | B2 | 1/2017 | Nilsson | |
| 9,726,304 | B2 | 8/2017 | Heath | |
| D805,880 | S | 12/2017 | Bright | |
| D811,205 | S | 2/2018 | Hanley | |
| D813,021 | S | 3/2018 | Hanley | |
| D813,022 | S | 3/2018 | Hanley | |
| 10,047,903 | B2 | 8/2018 | Bruno | |
| 10,064,512 | B2 | 9/2018 | McMillion | |
| 10,070,748 | B2 | 9/2018 | Hanley | |
| 10,092,126 | B2 | 10/2018 | Baines | |
| 10,094,167 | B2 | 10/2018 | Odish | |
| 10,123,647 | B1 * | 11/2018 | Mustafa | F16B 7/0433 |
| D834,925 | S | 12/2018 | Hanley | |
| D834,926 | S | 12/2018 | Hanley | |
| D834,927 | S | 12/2018 | Hanley | |
| D838,610 | S | 1/2019 | Odish | |
| D847,613 | S | 5/2019 | Hanley | |
| 10,278,529 | B2 | 5/2019 | Baines | |
| 10,285,527 | B2 | 5/2019 | Mullet | |
| D856,785 | S | 8/2019 | Hanley | |
| 10,376,086 | B1 * | 8/2019 | Mustafa | A47H 1/122 |
| D858,259 | S | 9/2019 | Hanley | |
| D858,260 | S | 9/2019 | Hanley | |
| D859,963 | S | 9/2019 | Hanley | |
| 10,441,098 | B2 | 10/2019 | Bruno | |
| 10,448,773 | B2 | 10/2019 | Muñiz | |
| 10,648,492 | B2 | 5/2020 | Hanley | |
| 10,724,678 | B1 | 7/2020 | Elliott | |
| D893,284 | S | 8/2020 | Hanley | |
| 10,765,247 | B2 * | 9/2020 | Moss | A47H 1/102 |
| 11,002,302 | B2 | 5/2021 | Hanley | |
| 11,092,176 | B2 | 8/2021 | Hanley | |
| 11,111,942 | B2 | 9/2021 | Cogburn | |
| 11,266,263 | B2 | 3/2022 | Moss | |
| 11,452,398 | B2 | 9/2022 | Berman | |
| 11,608,628 | B2 | 3/2023 | Allen | |
| 11,805,931 | B2 | 11/2023 | Berman | |
| 2002/0066842 | A1 | 6/2002 | Curry | |
| 2003/0071181 | A1 | 4/2003 | Valiulis | |
| 2004/0159766 | A1 | 8/2004 | Skorka | |
| 2004/0195477 | A1 | 10/2004 | Rivellino | |
| 2005/0218284 | A1 | 10/2005 | Kurrasch | |
| 2006/0130983 | A1 | 6/2006 | Nien | |
| 2008/0156952 | A1 | 7/2008 | Nathan | |
| 2008/0237434 | A1 | 10/2008 | Lin | |
| 2009/0101609 | A1 | 4/2009 | Batshon | |
| 2009/0193938 | A1 | 8/2009 | Mentor | |
| 2010/0224749 | A1 | 9/2010 | Tran | |
| 2012/0001039 | A1 | 1/2012 | McDuff | |
| 2012/0217362 | A1 * | 8/2012 | Affonso | A47H 1/142 248/222.14 |
| 2013/0043357 | A1 | 2/2013 | McLeod | |
| 2013/0082017 | A1 * | 4/2013 | Tang | A47H 13/01 211/124 |
| 2013/0099080 | A1 | 4/2013 | Baines | |
| 2013/0200024 | A1 | 8/2013 | Lindo | |
| 2013/0341474 | A1 | 12/2013 | Baines | |
| 2014/0360960 | A1 | 12/2014 | Didehvar | |
| 2015/0108304 | A1 | 4/2015 | Larsen Roldan | |
| 2015/0265086 | A1 | 9/2015 | Hanley | |
| 2015/0272353 | A1 | 10/2015 | Christodoulou | |
| 2015/0297038 | A1 | 10/2015 | Vaccaro | |
| 2016/0113447 | A1 | 4/2016 | Walker | |
| 2016/0215922 | A1 | 7/2016 | McDuff | |
| 2016/0286999 | A1 | 10/2016 | McMillion | |
| 2017/0071390 | A1 | 3/2017 | Moss | |
| 2018/0014680 | A1 | 1/2018 | Hanley | |
| 2018/0064279 | A1 * | 3/2018 | Hanley | F16B 45/00 |
| 2018/0098656 | A1 | 4/2018 | Baines | |
| 2018/0199747 | A1 | 7/2018 | Moss | |
| 2018/0306219 | A1 | 10/2018 | Hanley | |
| 2019/0063671 | A1 | 2/2019 | McDuff | |
| 2019/0099034 | A1 | 4/2019 | Hanley | |
| 2019/0282017 | A1 | 9/2019 | Hanley | |
| 2020/0200199 | A1 | 6/2020 | Hanley | |
| 2020/0217338 | A1 | 7/2020 | Hanley | |
| 2020/0305629 | A1 | 10/2020 | Hanley | |
| 2020/0325925 | A1 | 10/2020 | Cogburn | |
| 2020/0345167 | A1 | 11/2020 | Klowan | |
| 2021/0252678 | A1 | 8/2021 | Jason | |
| 2021/0364027 | A1 | 11/2021 | Cogburn | |
| 2023/0165396 | A1 | 6/2023 | Berman | |

OTHER PUBLICATIONS

U.S. Appl. No. 17/890,106, filed Aug. 17, 2022.
U.S. Appl. No. 18/164,430, filed Feb. 3, 2023.
U.S. Appl. No. 16/749,770, filed Jan. 22, 2020, 43 pages.
U.S. Appl. No. 17/951,709, filed Sep. 23, 2022, 26 pages.
U.S. Appl. No. 17/964,736, filed Oct. 12, 2022.

* cited by examiner

BRACKET FOR SURFACE MOUNTING

CROSS-REFERENCE TO RELATED APPLICATIONS

This application is a continuation of U.S. application Ser. No. 17/879,640, filed Aug. 2, 2022, which is a continuation of U.S. application Ser. No. 16/800,594, filed Feb. 25, 2020, now U.S. Pat. No. 11,452,398, which is a continuation-in-part of and claims priority to U.S. application Ser. No. 16/749,770, filed Jan. 22, 2020, abandoned, which are hereby incorporated by reference herein in their entireties.

FIELD OF THE INVENTION

The subject matter of this application relates to brackets and, more particularly, to brackets for surface mounting.

BACKGROUND

Many support structures are attached walls. Such items can include drapery rods, shelves and hooks to name a few. These support structures carry the weight of the various items that are suspended from them or placed on them. These support structures commonly use a mounting bracket that attaches to the wall board or support structure of the wall. A typical mounting bracket is affixed to the wall using fasteners, such as screws or nails. The fasteners are inserted into the support structure (e.g., a wood column) or into an anchor embedded in the wall material (e.g., drywall).

A typical mounting bracket takes the form of an L-shape structure with legs at 90 degrees to one another when not subject to a load. A vertical leg extends down along the wall, and a horizontal leg cantilevers out from the wall. The vertical leg is affixed to the wall with fasteners. So, the fasteners are aligned vertically and below the horizontal leg.

It is well known that mounting the bracket to the wall support column can enable the bracket to carry additional load. However, in many cases, it is not possible to mount the bracket the wall support column because of the desired location of the support structures. For instance, the columns may not line up with where the brackets need to be affixed to center the support structure on a wall. Thus, it is typically necessary to use wall anchors along with the fasteners. Using anchors is not nearly as strong an attachment as using the columns. For example, it has been found that with a bracket having a vertical arm length of 2.43 inches and a horizontal arm length of 5.52 inches the bracket will pull away from the wall under a load of 15 lbs at its distal end. The same result was found for a bracket with a vertical arm length of 1.73 inches and a horizontal arm length of 3.269 inches.

Thus, there is a desire for an easy to install bracket that supports more weight than the typical L-shaped brackets and that does so using not only the column for attachment but also into the wall covering material.

DETAILED DESCRIPTION

Figure 1:
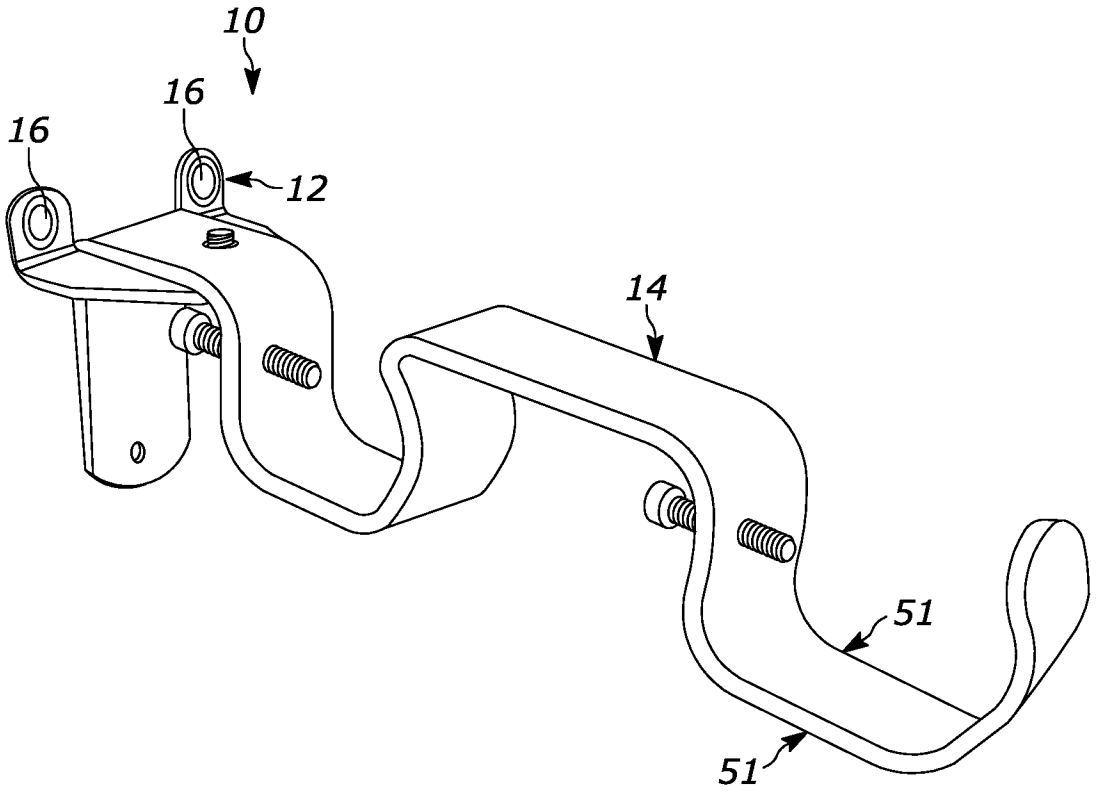
FIG. 1 is a perspective view of a first rod bracket.
Figure 2:
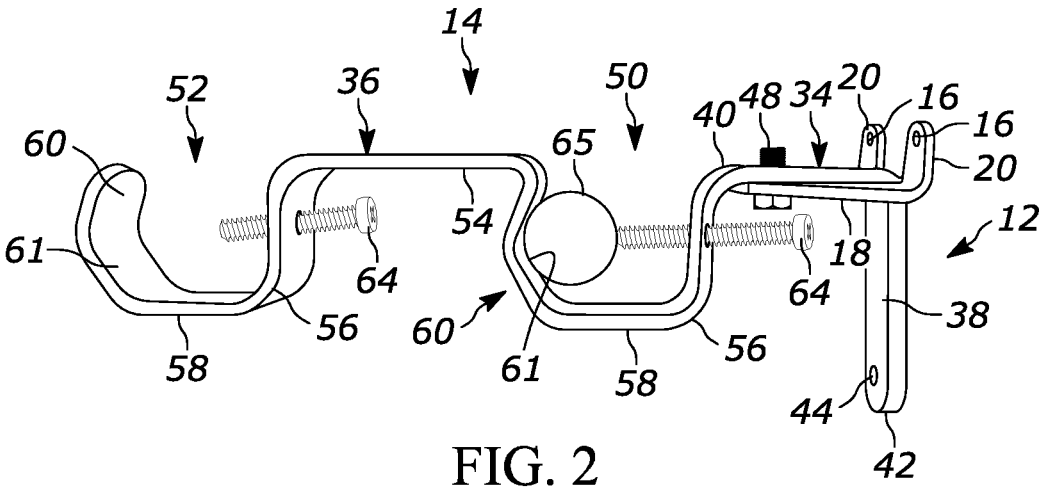
FIG. 2 is a side elevation view of the rod bracket of FIG. 1.
Figure 3:
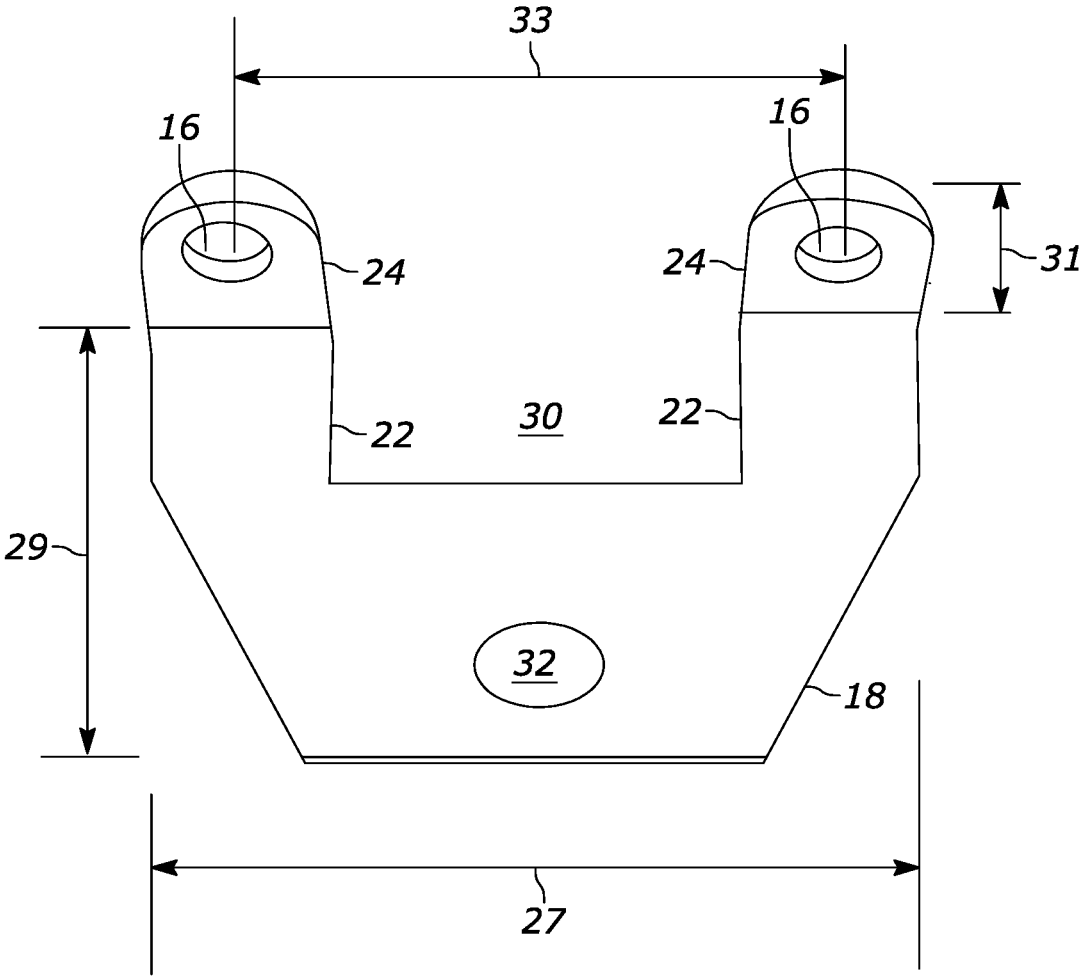
FIG. 3 is a top perspective view of a mounting bracket of the rod bracket of FIG. 1.
Figure 4:
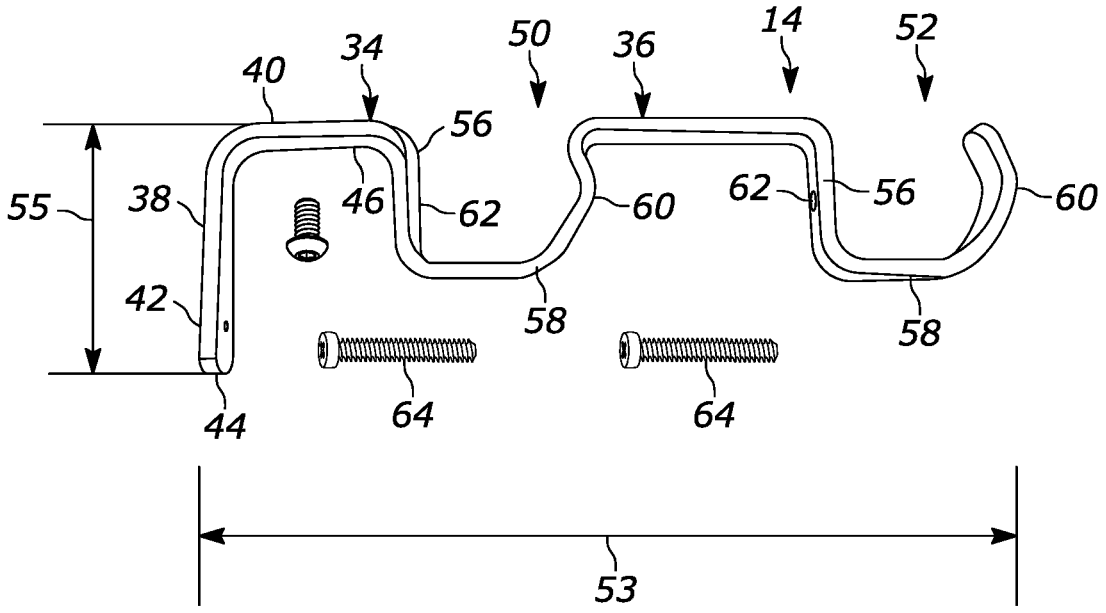
FIG. 4 is a side elevation view of a support bracket of the rod bracket of FIG. 1.
Figure 5:
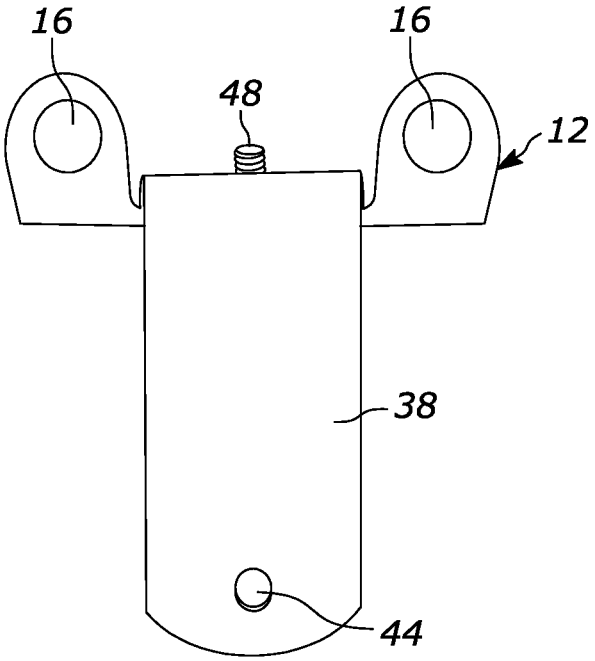
FIG. 5 is a rear elevation view of the rod bracket of FIG. 1.
Figure 6:
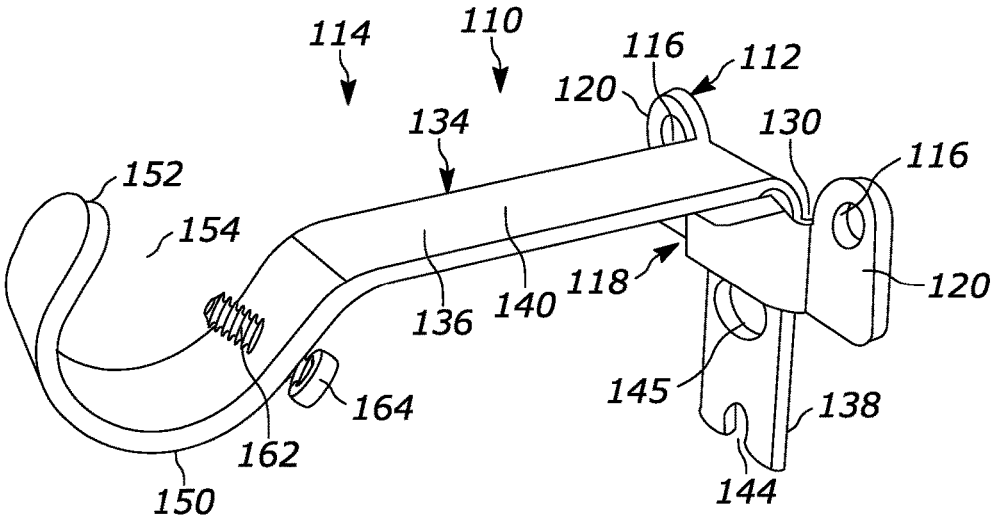
FIG. 6 is a perspective view a second rod bracket.
Figure 7:
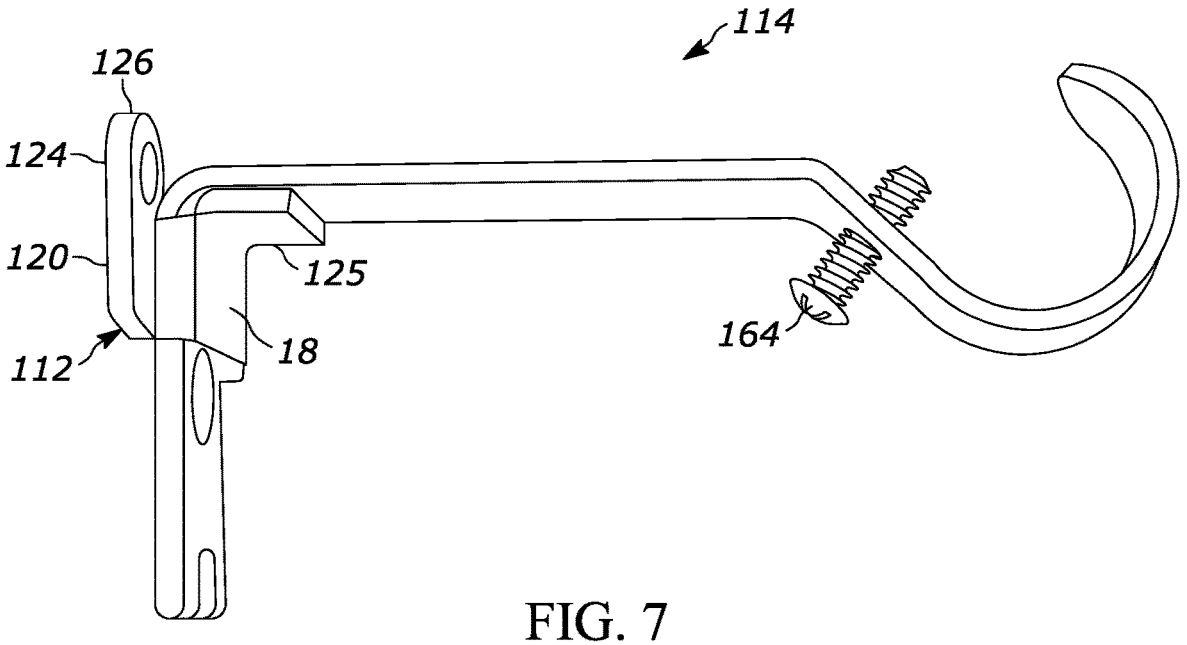
FIG. 7 is a side elevation view of the rod bracket of FIG. 6.
Figure 8:
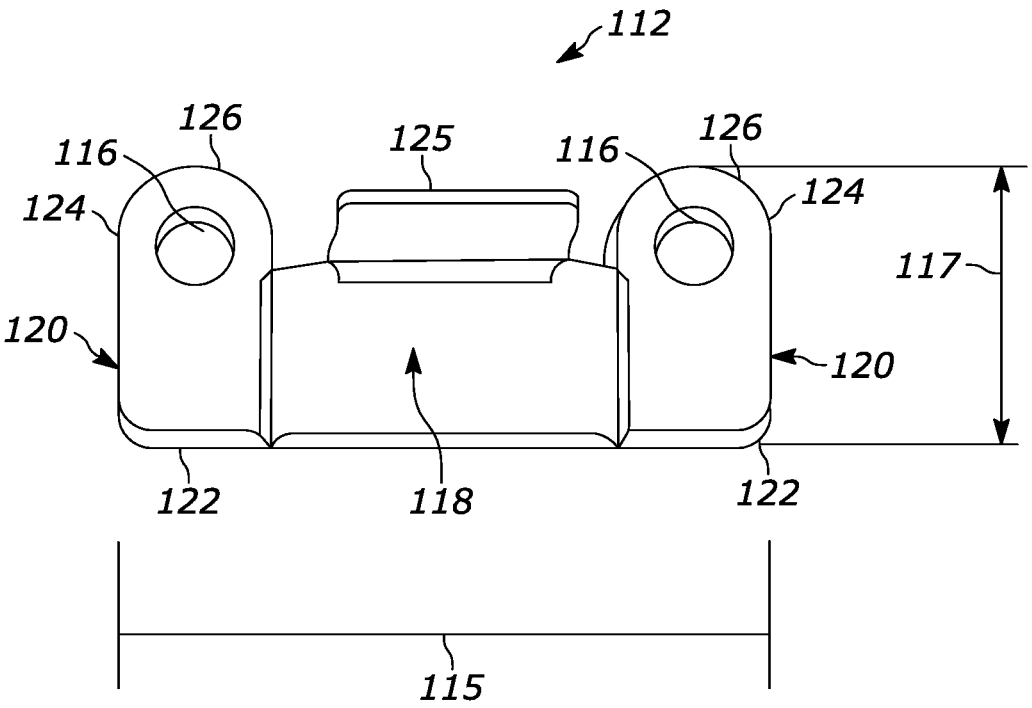
FIG. 8 is a front elevation view of a mounting bracket of the rod bracket of FIG. 6.
Figure 9:
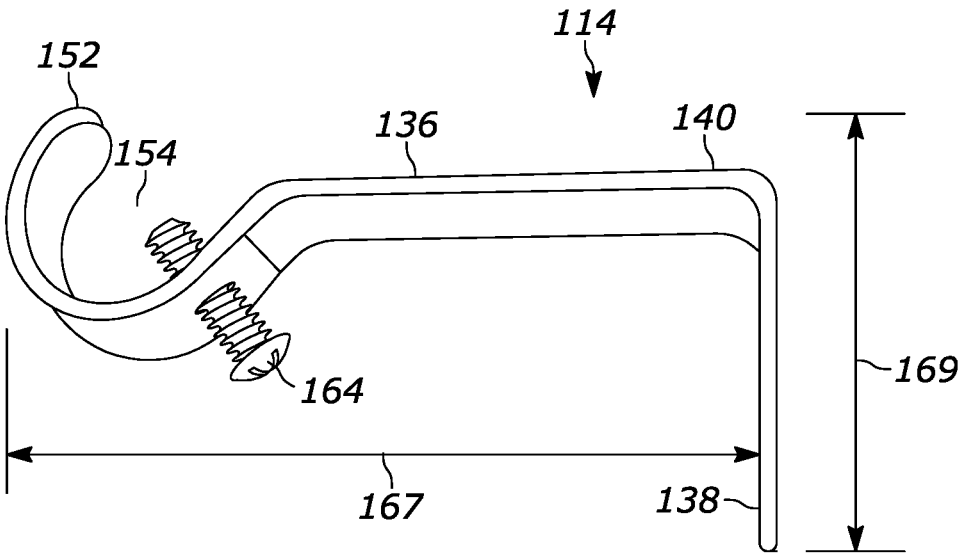
FIG. 9 is a side elevation view of a support bracket of the rod bracket of FIG. 6.
Figure 10:
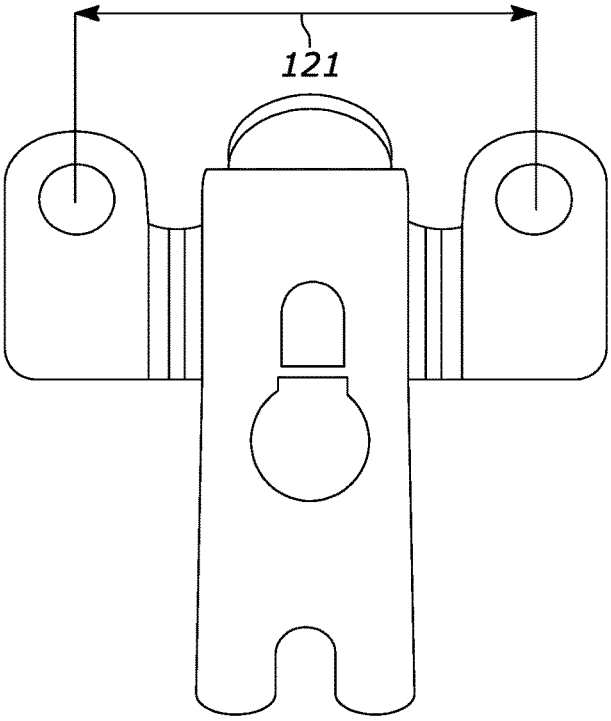
FIG. 10 is a rear elevation view of the rod bracket of FIG. 6.
Figure 11:
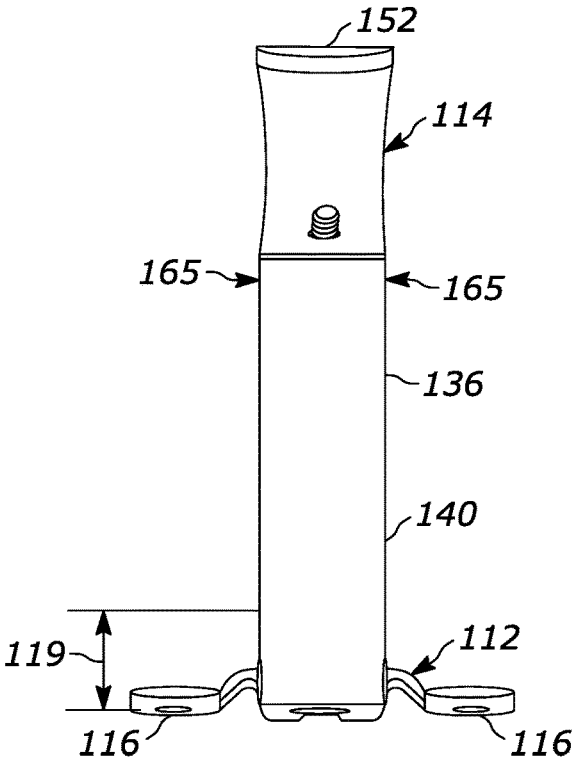
FIG. 11 is a top plan view of the rod bracket of FIG. 6.
Figure 12:
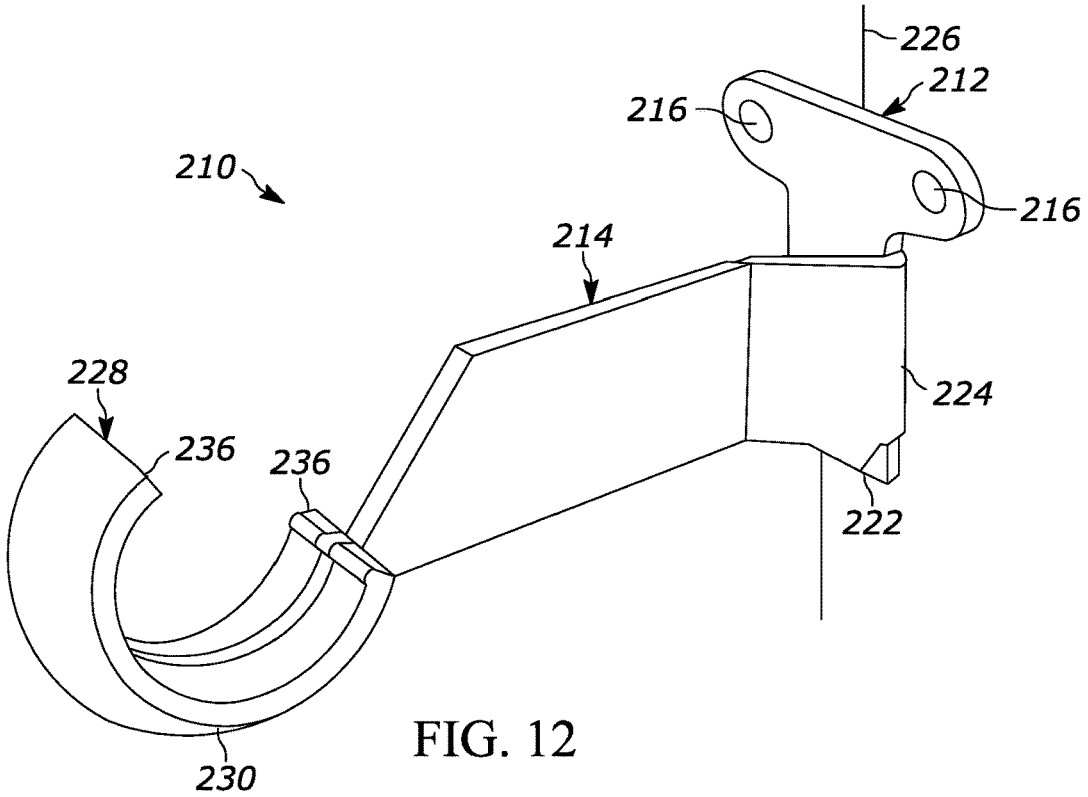
FIG. 12 is a perspective view of a third rod bracket.
Figure 13:
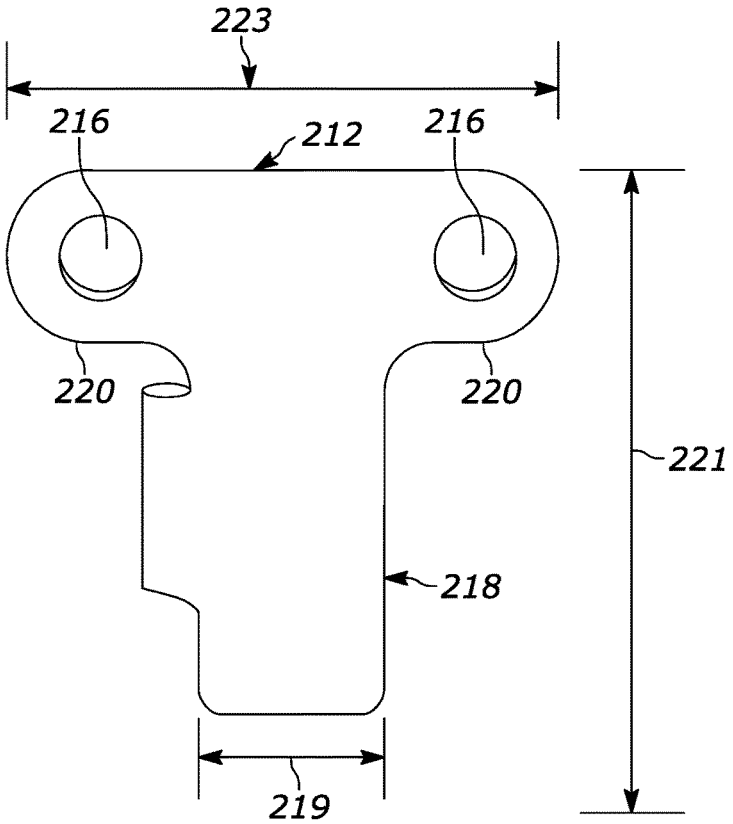
FIG. 13 is a rear elevation view of the rod bracket of FIG. 12.
Figure 14:
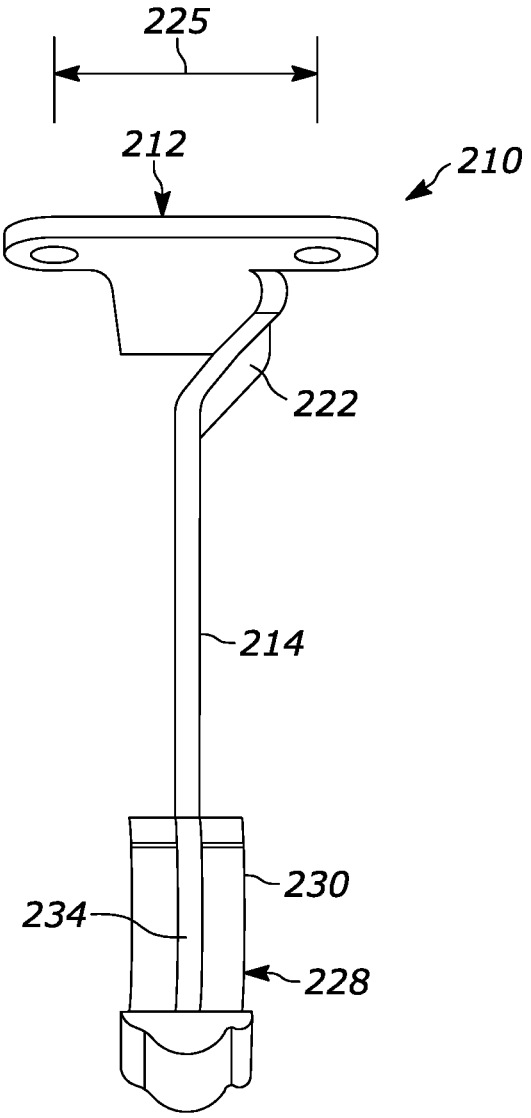
FIG. 14 is a top perspective view of the rod bracket of FIG. 12.
Figure 15:
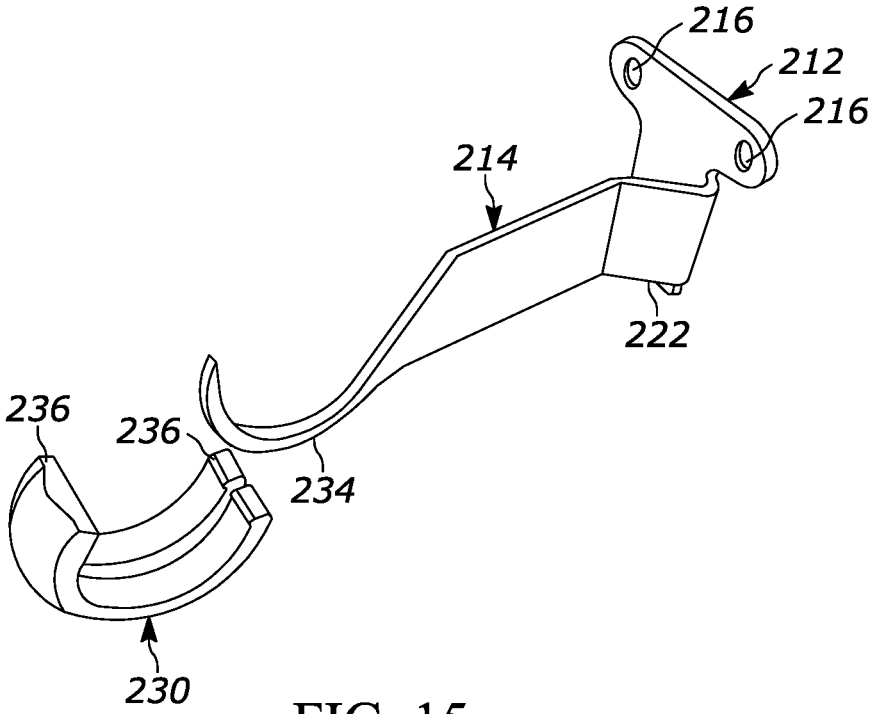
FIG. 15 is an exploded view of the rod bracket of FIG. 12.
Figure 16:
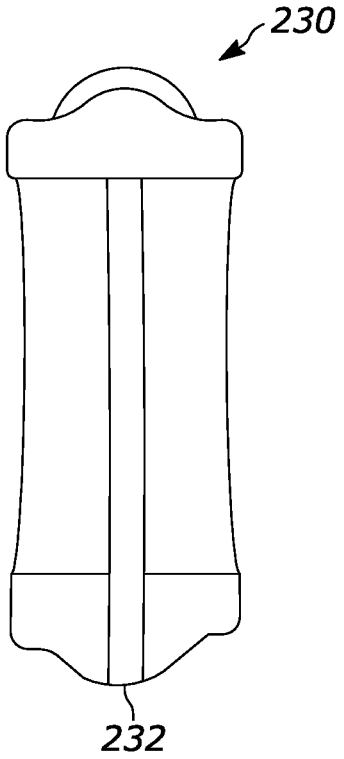
FIG. 16 is a top plan view of a fitting of the rod bracket of FIG. 12.
Figure 17:
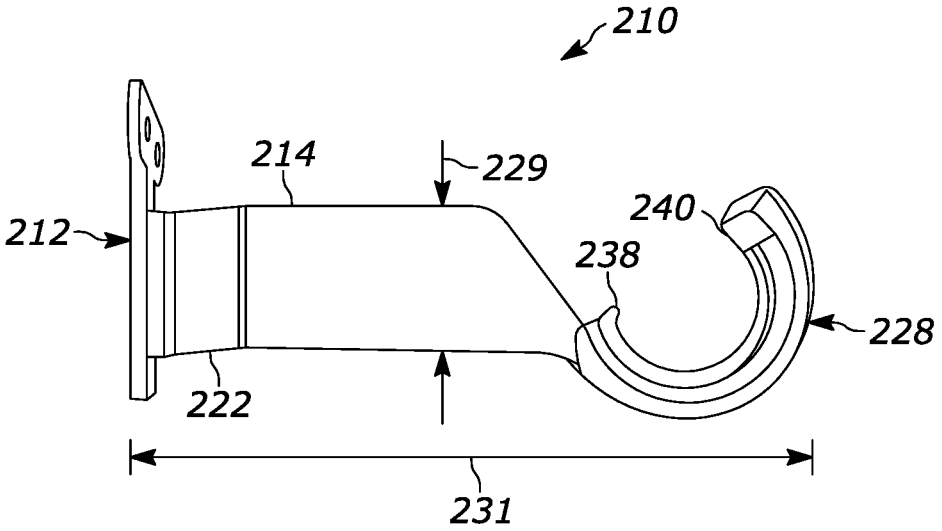
FIG. 17 is a side elevation view of the rod bracket of FIG. 12.

With reference to FIGS. 1-5, there is illustrated a two-piece bracket 10. The bracket 10 is designed to be used with another bracket 10 to support two rods, such as sheer and drapery rods. The bracket 10 includes a mounting bracket 12 and an arm 14. The mounting bracket 12 includes a pair of mounting holes 16 that are spaced horizontally from one at the top of mounting bracket 12 and generally at or above the arm 14. It has been found that having the mounting holes 16 at the top of the mounting bracket 12 (and generally at or above the arm 14) and spaced laterally from one another increases the load capacity of the bracket 10 over traditional L-shaped brackets where the mounting holes are aligned vertically and located below the arm.

The mounting bracket 12 includes a main body 18 and tabs 20 extending parallel to one another. Each tab 20 includes a proximal segment 22 and a distal segment 24. The proximal segment 22 extends in the same plane as the main body 18, and the distal segment 24 extends upward generally perpendicular to the proximal segment 22. Each distal segment 24 defines one of the mounting holes 16. As illustrated, the mounting holes 16 are located outside laterally of the support bracket 14, one on each side of the arm 14. The lateral spacing of the mounting holes 16 has been found to increase the holding strength of the bracket 10. As illustrated, the mounting holes 16 are above the arm 14 and outside the arm 14. More specifically, one hole 16 is located outside the arm 14 on one side and the other hole 16 is located outside the arm 14 on the other side. The holes 16 also are located at the top of the bracket 10 for ease of mounting Alternatively, the mounting bracket 12 could be mounted with the holes 16 located at the bottom of the bracket 10. That is, the mounting bracket 12 could be rotated 180 degrees from the position shown in FIG. 1 and then mounted to a wall.

One non-limiting example of a mounting bracket 12 could have a width 27 of 1.590 inches, a depth 29 of 1.157 inches and a height 31 of 0.0383 inches. The lateral spacing 33 between the centers of the mounting holes 16 could be 1.212 inches. The length of the body portion 18 could be 0.63 inches. The use of the mounting bracket 10 with the arm 14 has been found to increase the load capacity by up to at least 25% over the same support bracket without using the mounting bracket 14.

The body portion also defines a threaded hole 32 used to secure the mounting bracket and the arm 14 together. A gap 30 is defined between the proximal segments 22 and receives a portion of the support bracket 14, as described further below.

The arm 14 includes an attachment portion 34 and a support portion 36. The attachment portion 34 includes a first arm 38 and a second arm 40. The arms 38, 40 are angled relative to one another, such as at 90 degrees. The first arm 38 is sized to extend through the gap 30 of the mounting bracket 12. A distal end portion 42 of the first arm 38 defines a hole 44 to receive a fastener to pin the first arm 38 to a wall or other structure to maintain vertical alignment. The second arm 40 is designed to rest on the main body 18 of the mounting bracket 12. The second arm 40 defines a hole 46 that aligns with the hole 32 of the main body 18 of the mounting bracket 16. A set screw 48 threads through the holes 32, 40 to affix the second arm 40 to the main body 18.

The support portion 36 includes an inner cradle 50 and an outer cradle 52 for supporting a pair of rods. The cradles 50, 52 are separated by a straight segment 54. Each cradle 50, 52 may include a straight back 56, a straight bottom 58 and a hooked front 60 with a V-shaped notch 61. Each straight back 56 may include a threaded hole 62 that receives a threaded thumb screw 64. Each screw 64 engages a rod and pushes the rod into a locking arrangement at the hooked front 60 so that the rod cannot unintentionally release upward from the cradle 50, 52. More specifically, the V-shaped notch 61 enables the hooked front 60 to accommodate a wide range of rod sizes including ⅜" to 1" outer diameter. For rods at the lower end of this range, in particular, the thumb screw 64 might pass above the rod if the rod rests on the bottom of the cradle 50, 52, which is not desired. It is therefore desired that the screw 64 be centered on the rod (see rod 65 in FIG. 2) to push the rod into the V-shaped notch regardless of the diameter of the rod. With the notch 61, the rod can be placed in the notch 61 and the thumb screw 64 then can be engaged with the rod to hold the rod in the notch 61. In this case, the rod could be suspended above the bottom of the cradle 50, 52. In some cases, a rod can sit on the bottom of the cradle 50, 52 and the thumb screw 64 can hold the rod in the notch 61.

One non-limiting example of the arm 14 could have a width 51 of 0.750 inches, a length 53 of 5.52 inches and a maximum height 55 of 1.750 inches. As noted above, it has been found that using the mounting bracket 12 with the arm 14 can increase the load of the bracket 10 up to at least 25%.

With reference to FIGS. 6-11, there is illustrated another two-piece bracket 110. The bracket 110 is similar to the bracket 10 described above except that it supports only one rod. The bracket 110 includes a mounting bracket 112 and an arm 114. The mounting bracket 110 includes a pair of mounting holes 116 that are spaced horizontally from one another at the top of the bracket 110. The mounting holes 116 also are located at least in part above the arm 114. The holes 116 also are located at the top of the bracket 10 for ease of mounting. As noted above, it has been found that locating the mounting holes 116 at the top of the bracket 112 and at least in part above the support bracket 114 and spaced horizontally from one another increases the load capacity of the bracket 110 over traditional L-shaped brackets where the mounting holes are aligned vertically.

The mounting bracket 112 includes a main body 118 and two arms 120 extending parallel to one another. Each arm 120 includes a proximal segment 122 and a distal segment 124. The proximal segment 122 and distal segment 124 extend in the same plane as one another. The main body 118 bridges between the proximal segments 124 and extends out of the plane of the proximal segments 122. Each distal segment 124 includes a terminal end 126 that defines one of the mounting holes 116. The horizontal lateral spacing of the mounting holes 116 has been found to increase the holding strength of the bracket 110. As illustrated, the mounting holes 116 are located outside laterally of the arm 114, one on each side of the arm 114. The mounting bracket 112 also includes a tongue 125 extending perpendicularly from the main body 118 underneath a portion of the supporting bracket 114. The tongue 125 supports the arm 114. While not shown, the tongue may include a threaded hole used to secure the arm 114 to the mounting bracket 112 using a screw.

One non-limiting example of a mounting bracket 112 could have a width 115 of 1.66 inches, a height 117 of 0.7 inches and a length 119 of 0.444 inches. The lateral spacing 121 between the centers of the mounting holes 116 could be 1.28 inches. The tongue 125 could have an extension of 0.331 inches from the main body 18. The use of the mounting bracket 110 with the arm 114 has been found to increase the load capacity of the same support bracket without using the mounting bracket 112.

The arm 114 includes an attachment portion 134 and a support portion 136. The attachment portion 134 includes a first arm portion 138 and a second arm portion 140. The arm portions 138, 140 are angled relative to one another, such as at 90 degrees. The first arm portion 138 is sized to extend through a gap 130 formed between the main portion 118 of the mounting bracket 112 and a wall or other mounting structure. A distal end portion 142 of the first arm portion 138 may define a slot 144 to receive a fastener to pin the first arm portion 138 to a wall or other structure. The first arm 138 also may define a key shaped opening 145 with a larger bottom portion and a relatively smaller upper portion to secure the first arm 138 to a wall or other structure. The slot 144 and the key shaped opening 145 may be used without the mounting bracket 112 to attach the arm 114 to a wall other support structure.

The second arm 140 is designed to rest on the tongue 125 extending from the main body 18 of the mounting bracket 12. While not shown, the second arm 40 may define a hole that aligns with a hole in the tongue 125 of the mounting bracket 112. A set screw may thread through to affix the second arm 140 to the main body 118.

The support portion 136 includes a cradle 150 for supporting a rod. The cradle 150 has a C-shaped configuration. The terminal end 152 of the cradle 150 terminates above the support portion 136 and forms an opening 154 that faces angularly rearward. The cradle 150 defines a threaded hole 162 adjacent the support portion 136. The threaded hole 162 receives a threaded thumb screw 164. The screw 164 engages a rod and pushes into a locking arrangement at the front of the cradle 150 so that the rod cannot unintentionally release upward from the cradle 150.

One non-limiting example of the arm 114 could have a width 165 of 0.6 inches, a length 167 of 3.181 inches and a maximum height 169 of 1.519 inches. As noted above, it has been found that using the mounting bracket 112 with the arm 114 can increase the load of the bracket 110.

With reference to FIGS. 12-17, there is illustrated a single piece bracket 210. The bracket 210 includes a mounting base 212 and a support arm 214. The base 212 includes a pair of mounting holes 216 that are spaced horizontally from one another above the arm 214. As noted above, it has been found that locating the mounting holes 216 above the arm 214 and spaced horizontally from one another increases the load capacity of the bracket 210 over traditional L-shaped brackets where the mounting holes are aligned vertically.

The base 212 includes a main body 218 and two arms 220 extending away from the base 212 in the same plane as the main body 218. As illustrated, the base 212 takes on a T-shaped configuration. The horizontal spacing of the mounting holes 216 has been found to increase the holding strength of the bracket 210. As illustrated, the mounting holes 216 are located outside laterally of the support arm 214. One non-limiting example of a mounting bracket 212 could have a width 219 of 0.606 inches and a height 221 of 1.498 inches. The lateral spacing 225 between the centers of the mounting holes 216 could be 1.007 inches.

The support arm 214 is affixed to the base 212 through a transition portion 222. The transition portion 222 extends from an edge 224 of the base 222 and angles toward a center line 226 of the base 212 so that the arm 214 extends away from the centerline 226 of the base 212. This centralizes the support arm 214 relative to the base 222. The bracket may be made from one piece of material and bent into configuration or may be made of several components affixed together, such as by welding. The arm 214 however could extend directly from the edge 224 without the transition portion.

The support arm 214 includes a cradle 228 for supporting a rod. The cradle 228 has a C-shaped configuration. The cradle 228 may include a fitting 230 that may provide a snap fit connection with a rod so that the rod does not unintentionally release from the cradle 228. More specifically, the fitting 230 may an arcuate groove 232 that receives a hook portion 234 of the cradle 228. The fitting 230 may be slid over the hook portion 234 using the groove 232. The fitting 230 has a C-shaped configuration with two ends 236 that may be spaced apart a distance less than the diameter of the rod. The fitting 230 may be elastomeric so that the ends 236 may separate as a rod is being positioned into the fitting 230, and once the rod is located in the fitting 230, the ends 236 move back to their static position. The fitting 230 is shown as being wider than the hook portion 234.

One non-limiting example of the support arm 214 could have a width 229 of 0.75 inches and a length 231 of 3.436 inches. The angle for the transition portion 222 may be 45 degrees relative to the main body 218 mounting bracket 212. It has been found that using mounting holes spaced laterally and horizontally and above the support arm can increase the load of the bracket 210. Further, the width 229 of the arm 214 extends in the vertical direction when the bracket 210 is mounted in use. This provides additional supporting strength.

Figure 18:
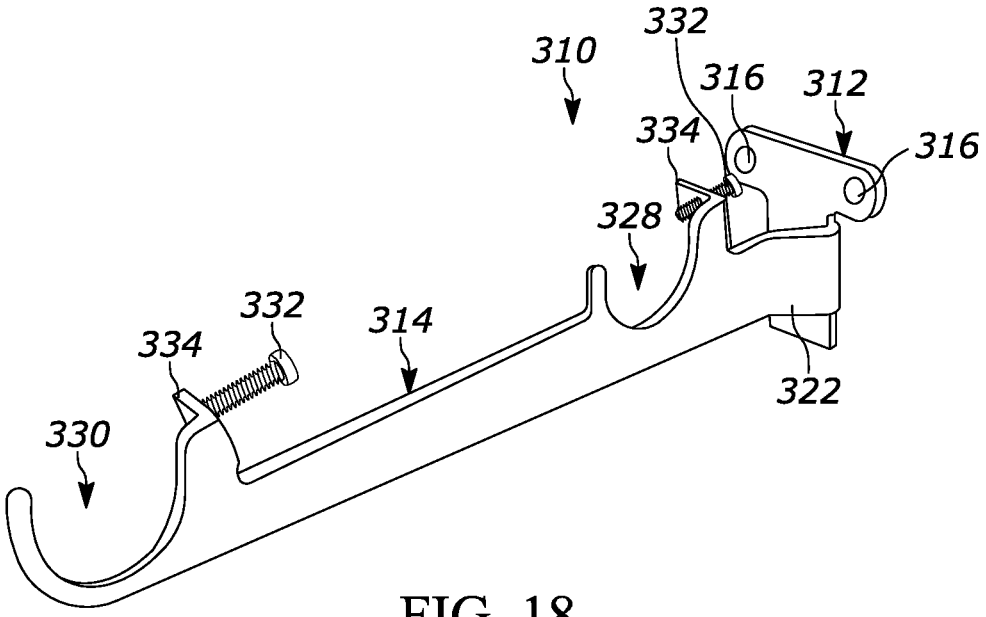
FIG. 18 is a perspective view of a fourth rod bracket.
Figure 19:
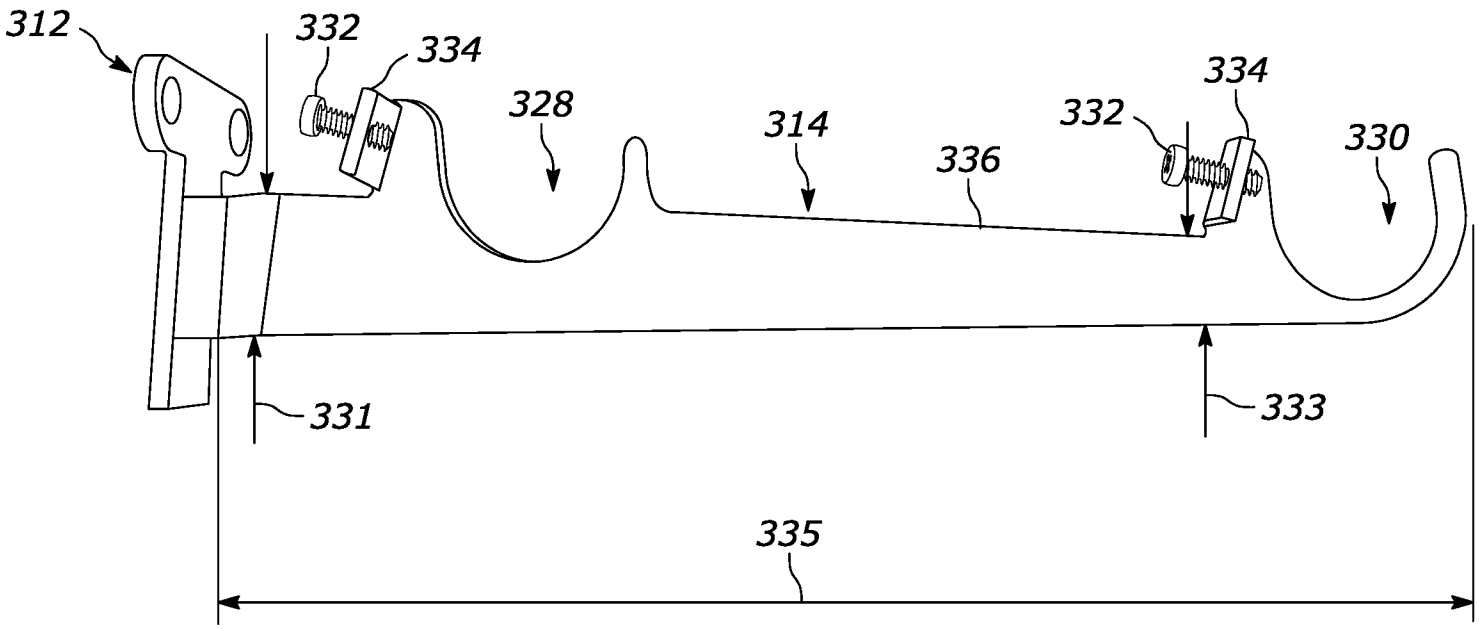
FIG. 19 is a side elevation view of the rod bracket of FIG. 18.
Figure 20:
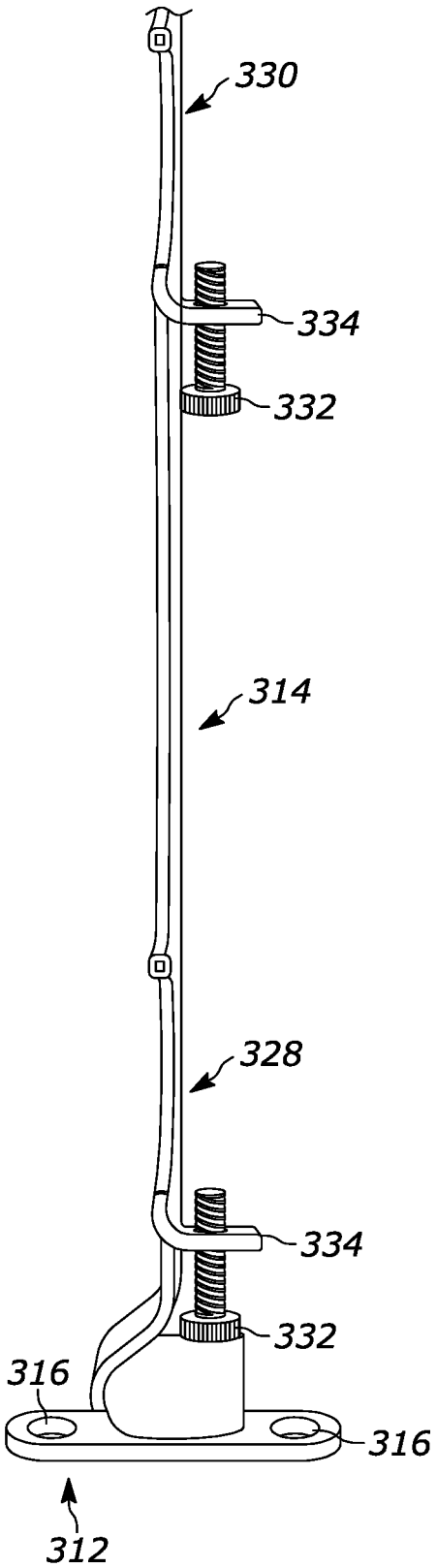
FIG. 20 is a top plan view of the rod bracket of FIG. 18.
Figure 21:
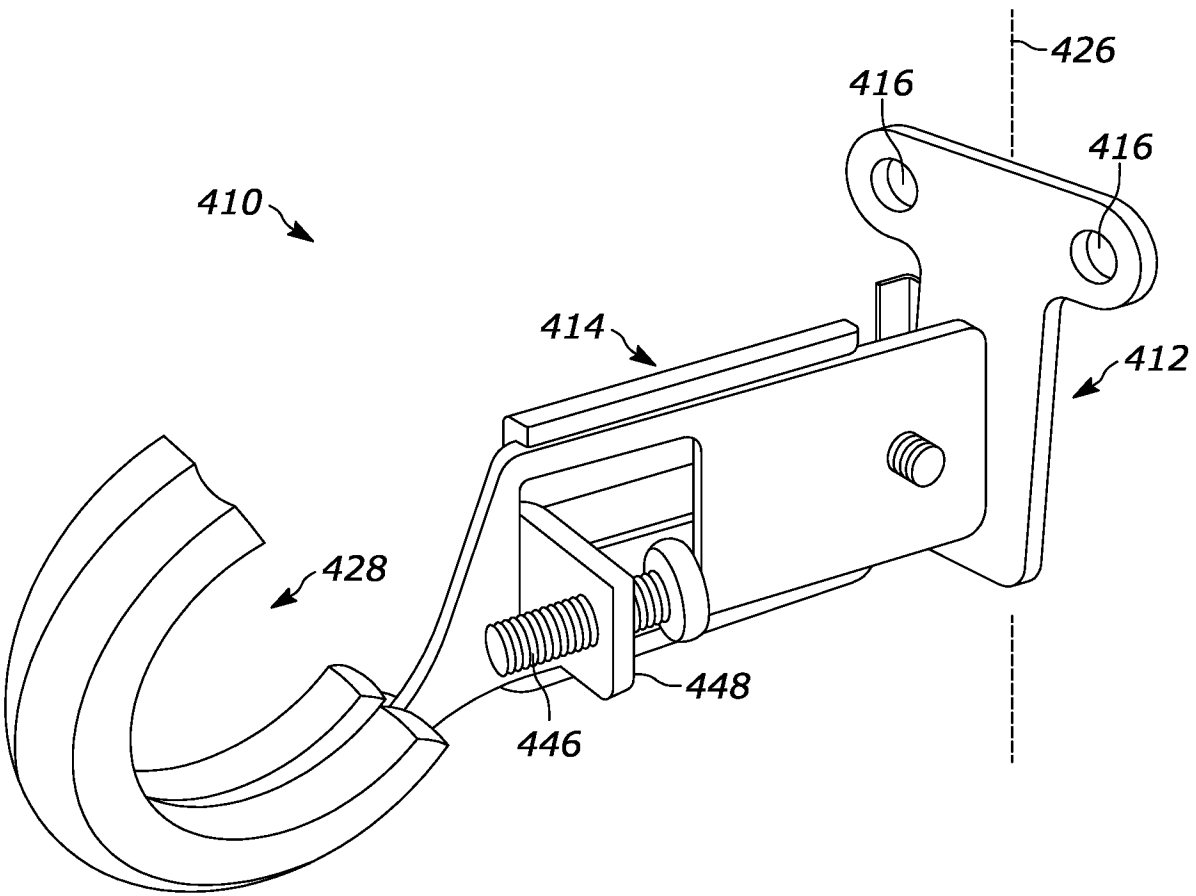
FIG. 21 is a perspective view of a fifth rod bracket.
Figure 22:
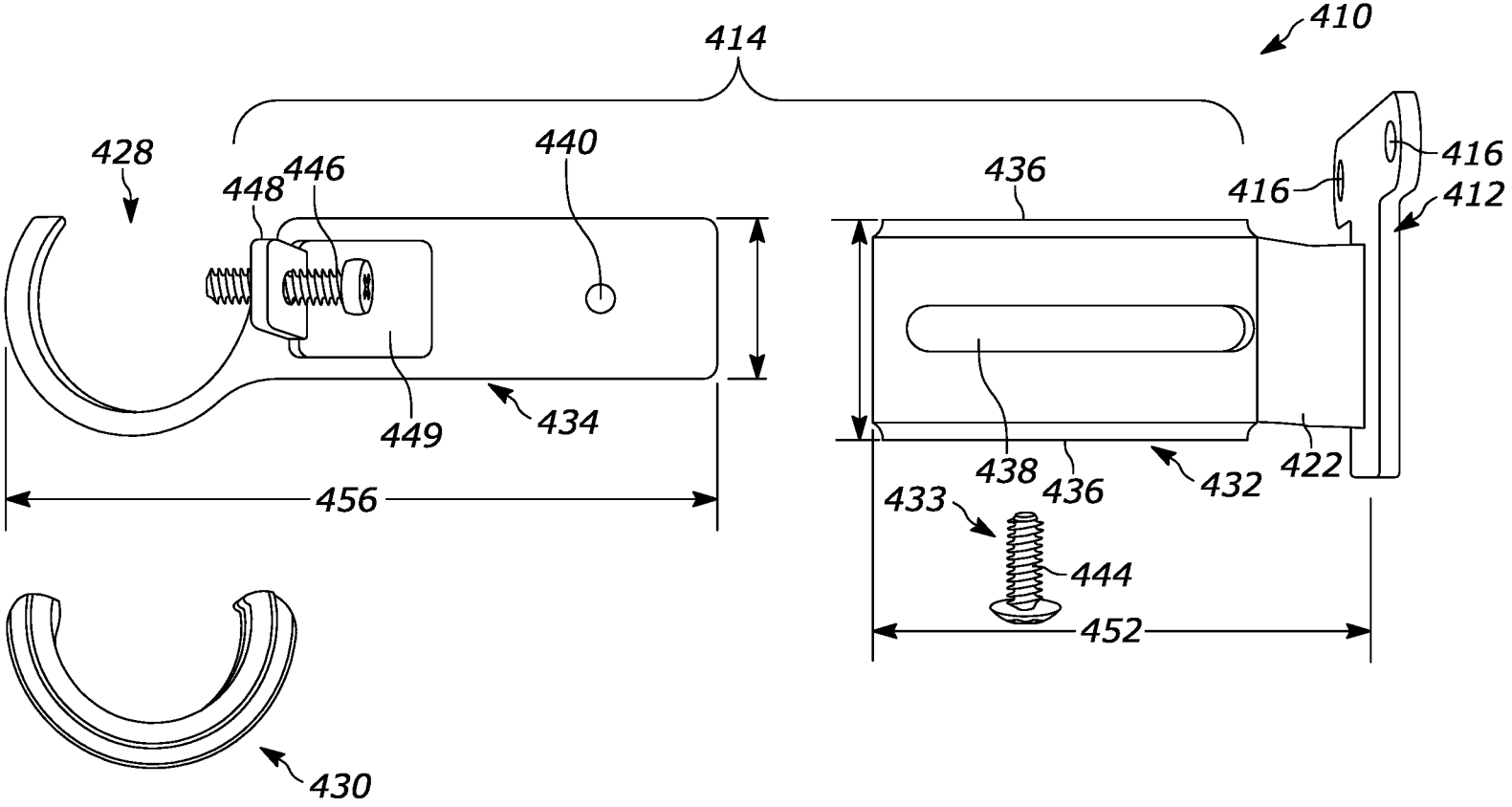
FIG. 22 is an exploded view of the rod bracket of FIG. 21.
Figure 23:
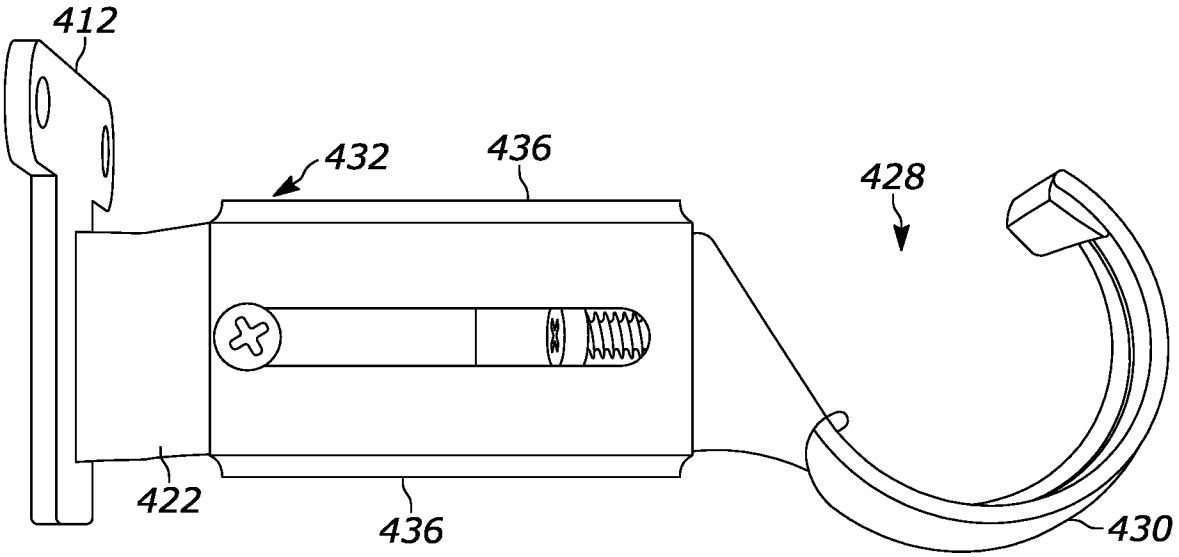
FIG. 23 is a side elevation view of the rod bracket of FIG. 21.
Figure 24:
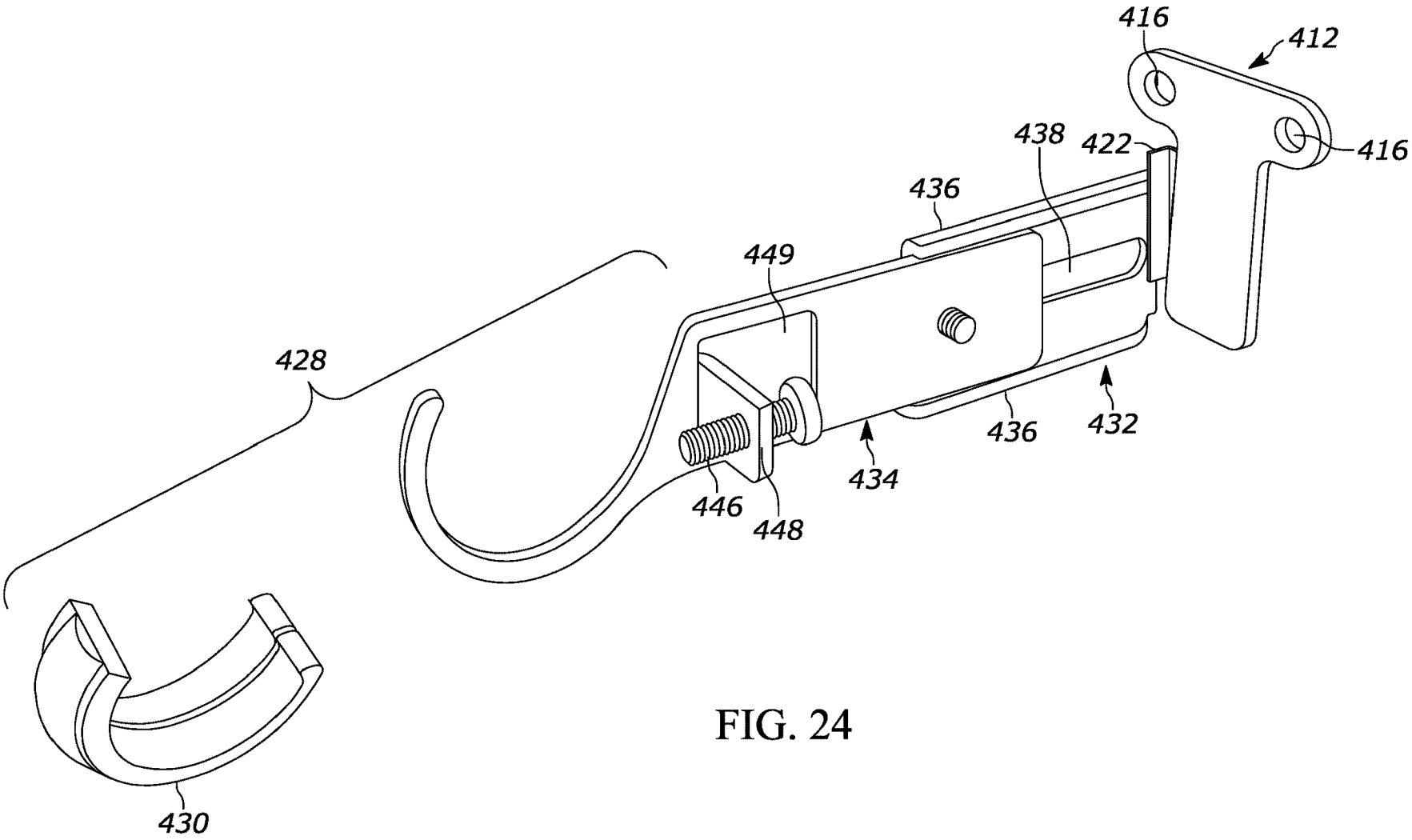
FIG. 24 is a partially exploded view of the rod bracket of FIG. 21.
Figure 25:
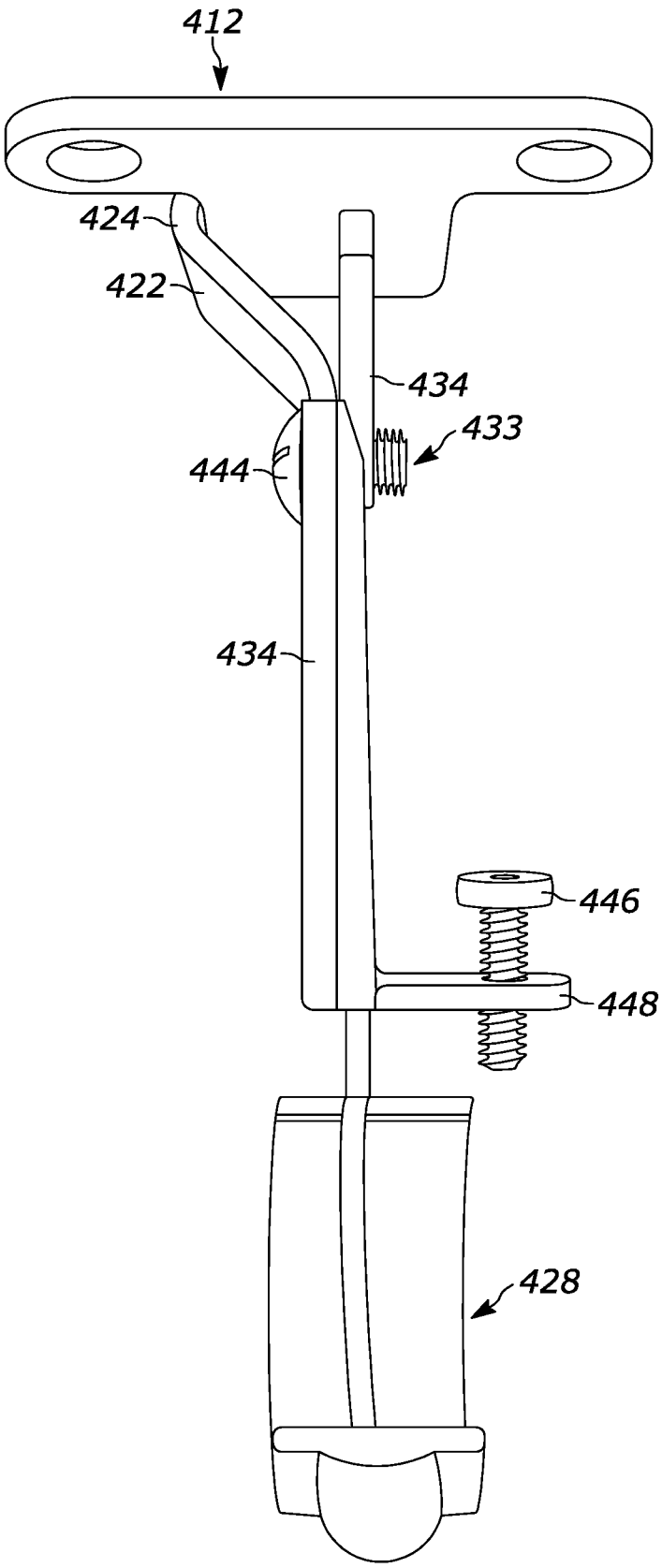
FIG. 25 is a top plan view of the rod bracket of FIG. 21.

Referring to FIGS. 18-20, there is illustrated a single piece bracket 310 similar to the bracket 210 described above except that the bracket 310 includes two cradles 328, 330. The bracket 310 includes a mounting base 312 and a support arm 314. The base 312 is identical to the base 212 described above, including having mounting holes 316 located above the arm 314 and spaced laterally and horizontally from one another to increase the load capacity of the bracket 310 relative to traditional L-shaped brackets where the mounting holes are aligned vertically.

The support arm 314 is affixed to the base 312 through a transition portion 322 identical to that for the bracket 210. The support arm 314 includes an inner cradle 328 for supporting a first rod and an outer cradle 330 for supporting a second rod. The inner cradle 328 may be adjacent the mounting base 312, and the outer cradle 330 may be at the end of the support arm 314. Each cradle 328, 330 may include a set screw 332 to engage the rod to secure it in the cradle 328, 330 against unintentional removal. The set screws 332 are supported by a tab 334 with a threaded hole. The tabs 334 may extend from the arm 314 adjacent the cradles 328, 330 and may angle the set screws 332 downward toward the cradles 328, 330. A top edge 336 of the support arm 314 may taper downward to lessen the height of the arm 314 as it progresses from the mounting base 312 to the outward cradle 330. The cradles 328, 330 may have an upward facing U-shaped configuration. The U-shaped configuration also may be tipped slightly toward the mounting base 312 to aid in maintaining the rod in the cradles 328, 330.

One non-limiting example of the support arm 314 could have a maximum width 331 of 0.68 inches, minimum width 333 of 0.44 inches and a length 335 of 5.84 inches. It has been found that using mounting holes spaced laterally and horizontally and above the support arm can increase the load of the bracket 310. Further, the width 331, 333 of the arm 314 extends in the vertical direction when the bracket 310 is mounted in use. This provides additional supporting strength.

With reference to FIGS. 21-25, there is illustrated a multi-piece extendable bracket 410. The bracket 410 includes a mounting base 412 and a two-piece support arm 414. The base 412 is identical to the base 212 described above, including having mounting holes 416 located above the arm 414 and spaced laterally and horizontally from one another to increase the load capacity of the bracket 410 relative to traditional L-shaped brackets where the mounting holes are aligned vertically.

The support arm 414 is affixed to the base 412 through a transition portion 422. The transition portion 422 extends from an edge 424 of the base 422 and angles toward a center line 426 of the base 412 so that the arm 414 extends away from the centerline 426 of the base 412. This centralizes the support arm 414 relative to the base 422. The bracket may be made from one piece of material and bent into configuration or may be made of several components affixed together, such as by welding. The arm 414 however could extend directly from the edge 424 without the transition portion.

The support arm 414 includes a cradle 428 for supporting a rod. The cradle 428 has an arcuate C-shaped configuration. The cradle 428 may include a fitting 430 that provides a snap fit connection with a rod so that the rod does not unintentionally release from the cradle 428. The fitting 430 is identical to the fitting 230 in both construction and the way it mounts to the arm 414 to form in part the cradle 428.

The support arm 414 is adjustable to change the extent of the arm 414. The support arm 414 can be extended to any extent between a fully retracted state (see FIG. 21) and a fully extended state (see FIG. 24). The support arm 414 includes a proximal segment 432 extending from the transition portion 422 and a distal segment 434 terminating with the cradle 428. The proximal segment 432 includes a pair of parallel rails 436 to engage and/or otherwise guide movement of the distal segment 434 relative to the proximal segment 432 and defines an elongated slot 438 used to lock the proximal and distal segments 432, 434 in place after making the desired length adjustment. The distal segment 434 defines a threaded hole 440 that aligns with the elongated slot 438 and cooperates with a screw 433 to lock the adjustment. The screw 433 extends through the elongated slot 438 and into the hole 440.

Once the proximal and distal segments 432, 434 are adjusted to the desired length for the support arm 414, the screw 433 is turned clockwise to clamp the proximal portion 432 between the distal segment 434 and a head 444 of the screw 433. To adjust the support arm 414, the screw 433 is turned counterclockwise an amount that allows the distal segment 434 to move relative to the proximal segment 432. The screw 433 does not have to be entirely removed from the hole 440 to make the adjustment. The head 444 may be configured to work with a tool, such as a screwdriver.

The cradle 428 may include a set screw 446 to engage the rod to secure it in the cradle 428 against unintentional removal. The set screw 446 is supported by a tab 448 with a threaded hole. The set screw 446 may be turned clockwise to engage the rod to secure the rod in the cradle 428, and it may be turned counterclockwise to release the rod from the cradle 428. The tab 448 could be formed from material of the distal segment 434 leaving a window 449 in the distal segment 434. For instance, the tab 448 could be stamped from the distal segment 434 and bent orthogonal to the distal segment 434.

One non-limiting example of the support arm 414 could have the following dimensions. The width 450 of the proximal segment 432 could be 0.925 inches, the length 452 of the proximal segment 432 could be 2.07 inches, the width 454 of the distal segment 434 could be 0.75 inches, and the length 456 of the distal segment 434 could be 3.303 inches. The length of the elongated slot 438 could be 1.379 inches. It has been found that using mounting holes 416 spaced laterally and horizontally and above the support arm can increase the load of the bracket 410. Further, the width 450, 454 of the arm 414 extends in the vertical direction when the bracket 410 is mounted in use. This provides additional supporting strength.

Figure 26:
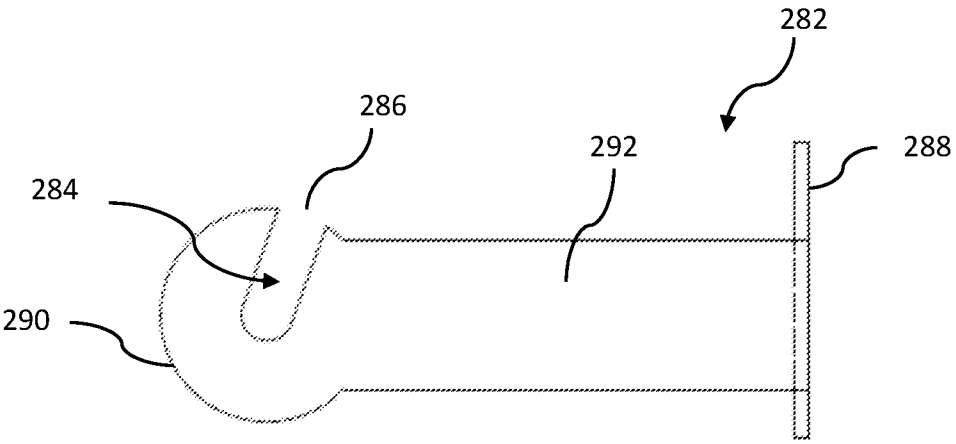
FIG. 26 is a side elevation view of another rod bracket.
Figure 28:
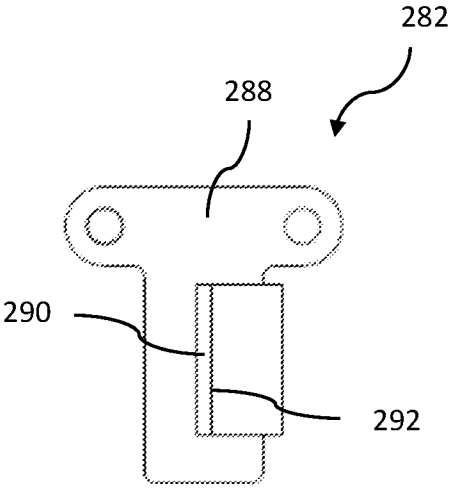
FIG. 28 is a front elevation view of the rod bracket of FIG. 26.
Figure 27:
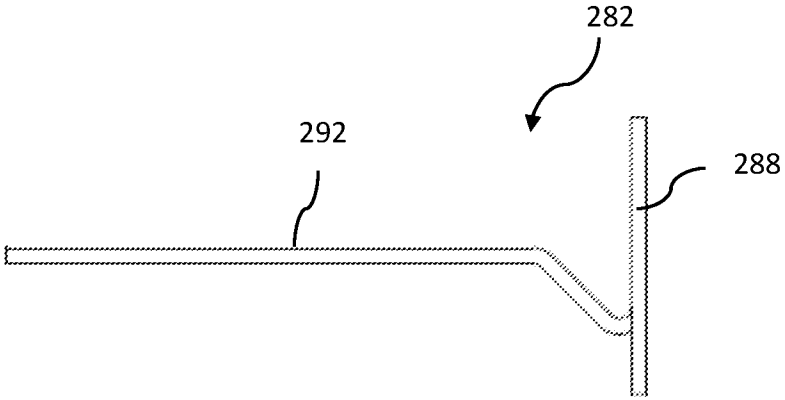
FIG. 27 is a top plan view of the rod bracket of FIG. 26.

Referring to FIGS. 26-28, there is illustrated a bracket 282 identical to that shown in FIGS. 12-15 with the exception that the bracket 282 does not include a cradle that engages an outer surface of a rod. Instead the bracket 282 includes a slot 284 that receives a shaft, such as a threaded shaft, associated with an end of a rod or a finial. The slot 284 includes an open end 286 so that a shaft can be pre-connected to both a finial and a rod end and, then, lowered into the slot 284. The slot 284 may also be canted, such as shown where it is canted back toward a mounting plate 288 of the bracket 182. It could be vertical or canted forward as well. Additional details of the slot 284 and the ability to conceal an end portion 290 of an arm 292 defining the slot 284 with either an end of a rod or a finial are discussed in U.S. patent application Ser. No. 15/922,653, filed Mar. 18, 2018 and entitled Support Bracket for Rod Assembly, which is incorporated by reference herein in its entirety.

The brackets above could be designed to support items other than rods. For example, the arms of the brackets could be straight and without cradles so that they could support shelving or could be formed with a hook to support hanging objects. All of the brackets described above may be made from metal, plastic or a combination of metal and plastic The following describes installing the brackets. For the two-piece brackets, the mounting bracket is located on the wall and attached to the wall using fasteners and the mounting holes. Then, the arm is inserted through the gap so that the arm rests on the mounting bracket. The portion of the arm that engages the wall can be pinned to the wall to maintain vertical alignment. Then, the rods can be mounted in the cradle by simply resting on the body of the cradle. In addition, the rods may be secured in the cradle either with a snap fit or a set screw. For the single piece brackets, the mounting portion can be mounted to the wall using the mounting holes and the fasteners. For the adjustable bracket, the adjustment can be made either before or after mounting the bracket. Each adjustable bracket should be set to the same length.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the technological contribution. The actual scope of the protection sought is intended to be defined in the following claims.

What is claimed is:

1. An apparatus comprising:

a mounting bracket having a first mounting arm and a second mounting arm connected by a main body, the first mounting arm and the second mounting arm each defining a mounting hole, at least a portion of a rear surface of the first mounting arm and at least a portion of a rear surface of the second mounting arm extending in a first plane for being positioned against a mounting surface;

the main body extending between the first mounting arm and second mounting arm in a second plane substantially parallel to the first plane such that the main body is spaced from the mounting surface when the mounting bracket is secured thereto; and an arm having an attachment portion at an angle relative to a support portion, the attachment portion to be extended along the mounting surface in a space between the main body, the first mounting arm, and the second mounting arm, the support portion resting on the mounting bracket and extending away from the from the mounting surface, wherein at least a portion of the mounting holes of the first mounting arm and second mounting arm are above the arm.

2. The apparatus of claim 1 wherein the mounting bracket includes a tongue extending at an angle from the main body to support the support portion of the arm.

3. The apparatus of claim 1 wherein the main body extends parallel to and along at least a portion of a length of the attachment portion of the arm.

4. The apparatus of claim 1 wherein the first mounting arm is spaced from the second mounting arm by a distance greater than a maximum width of support portion of the arm such that the mounting hole of the first mounting arm is outside the support portion on one side of the arm and the mounting hole of the second mounting arm is outside the support portion on the other side of the arm.

5. The apparatus of claim 1 wherein the first mounting arm and second mounting arm each include a proximal segment and a distal segment, the main body bridging between the proximal segments of the first and second mounting arms.

6. The apparatus of claim 5 wherein the distal segments of the first mounting arm and second mounting arm define the mounting holes.

7. The apparatus of claim 1 wherein the attachment portion of the arm defines an opening to receive a fastener for securing the arm to the mounting surface.

8. The apparatus of claim 1 further comprising a cradle for supporting a rod at an end of the arm opposite the attachment portion.

9. A bracket comprising:

a base having a main body and a first mounting arm and a second mounting arm extending from the main body, the first mounting arm spaced from the second mounting arm along the main body and defining a gap therebetween, the first mounting arm and second mounting arm each defining a mounting hole sized to receive a fastener to mount the bracket to a structure;

an arm having an attachment portion at an angle relative to a support portion, the attachment portion sized to extend through the gap of the base to contact the structure, the support portion sized to rest on the main body of the base, wherein at least a portion of the mounting holes is above a top of the arm.

10. The bracket of claim 9 wherein the main body and the gap reside in a first plane.

11. The bracket of claim 9 wherein the mounting holes and the gap reside in a second plane.

12. The bracket of claim 9 wherein the first mounting arm and the second mounting arm space the main body from the structure.

13. The bracket of claim 9 wherein the first mounting arm extends from the main body parallel to the second mounting arm.

14. The bracket of claim 9 wherein the first mounting arm and the second mounting arm each include a proximal segment and a distal segment, the distal segments each defining the mounting holes.

15. The bracket of claim 9 wherein the arm defines a first hole that aligns with a second hole defined by the main body to secure the arm to the main body.

16. The bracket of claim 9 wherein the mounting holes are spaced from another by a distance greater than a maximum width of the arm at the support portion so that one of the mounting holes is outside the arm on one side of the arm and the other of the mounting holes is outside the arm on the other side of the arm.

17. The bracket of claim 9 wherein the attachment portion of the arm defines an attachment hole sized to receive a fastener to secure the arm to the structure.

18. A bracket comprising:

a base having a main body and a first mounting arm and a second mounting arm extending from the main body, the first mounting arm spaced from the second mounting arm along the main body and defining a gap therebetween, the first mounting arm and second mounting arm each defining a mounting hole sized to receive a fastener to mount the bracket to a structure;

an arm having an attachment portion at an angle relative to a support portion, the attachment portion sized to extend through the gap of the base to contact the structure, the support portion sized to rest on the main body of the base, wherein the first mounting arm and the second mounting arm each include a proximal segment and a distal segment, the distal segments each defining the mounting holes, wherein the proximal segments of the first mounting arm and the second mounting arm are at an angle relative to the distal segments.

19. A bracket comprising:

a base having a main body and a first mounting arm and a second mounting arm extending from the main body, the first mounting arm spaced from the second mounting arm along the main body and defining a gap therebetween, the first mounting arm and second mounting arm each defining a mounting hole sized to receive a fastener to mount the bracket to a structure;

an arm having an attachment portion at an angle relative to a support portion, the attachment portion sized to extend through the gap of the base to contact the structure, the support portion sized to rest on the main body of the base, wherein the first mounting arm and the second mounting arm each include a proximal segment and a distal segment, the distal segments each defining the mounting holes, wherein the proximal segments of the first mounting arm and the second mounting arm extend substantially parallel to the main body.

* * * * *